US010118719B2

(12) United States Patent
Ehrmann

(10) Patent No.: US 10,118,719 B2
(45) Date of Patent: Nov. 6, 2018

(54) THERMOFORMING PACKAGING MACHINE WITH A TOP FILM FORMING STATION

(71) Applicant: MULTIVAC SEPP HAGGENMÜLLER GMBH & CO. KG, Wolfertschwenden (DE)

(72) Inventor: Elmar Ehrmann, Bad Grönenbach (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 428 days.

(21) Appl. No.: 14/599,297

(22) Filed: Jan. 16, 2015

(65) Prior Publication Data

US 2015/0203223 A1 Jul. 23, 2015

(30) Foreign Application Priority Data

Jan. 21, 2014 (EP) ..... 14151966

(51) Int. Cl.
*B65B 31/02* (2006.01)
*B65B 7/16* (2006.01)
(Continued)

(52) U.S. Cl.
CPC ..... *B65B 31/02* (2013.01); *B65B 7/01* (2013.01); *B65B 7/164* (2013.01); *B65B 31/021* (2013.01);
(Continued)

(58) Field of Classification Search
CPC ..... B65B 31/02; B65B 65/02; B65B 31/00; B65B 47/02; B65B 25/06; B65B 31/021;
(Continued)

(56) References Cited

U.S. PATENT DOCUMENTS 4,040,561 A * 8/1977 Philippon ..... B65B 7/168 229/102
6,006,505 A * 12/1999 Natterer ..... B65B 65/02 53/374.8
(Continued)

FOREIGN PATENT DOCUMENTS

CN 1032426 A 4/1989
CN 1671594 A 9/2005
(Continued)

OTHER PUBLICATIONS

Natterer et al., "Workstation in a packaging machine with movable lower part", EP 0569937 A1, Translated by Machine (Goolge).*
(Continued)

*Primary Examiner* — Matthew J Daniels
*Assistant Examiner* — Yunju Kim
(74) *Attorney, Agent, or Firm* — Husch Blackwell LLP

(57) ABSTRACT

A thermoforming packaging machine with a top film forming station, wherein the forming tool upper part and the foaming tool lower part of the top film forming station are disposed above a transportation plane of a lower film. One of the forming tool upper part or the forming tool lower part are operably connected to a lifting mechanism by a traverse system. The lifting mechanism is disposed below the transportation plane of the lower film. The traverse system transfers a lifting force from the lifting device to one of the forming tool upper part or lower part through the transportation plane of the lower film.

20 Claims, 4 Drawing Sheets

(51) Int. Cl.

| | |
|---|---|
| ***B65B 7/01*** | (2006.01) |
| ***B65B 65/02*** | (2006.01) |
| ***B65B 47/04*** | (2006.01) |
| ***B65B 61/06*** | (2006.01) |
| ***B65B 61/08*** | (2006.01) |

(52) U.S. Cl.
CPC ..... *B65B 47/04* (2013.01); *B65B 65/02* (2013.01); *B65B 61/065* (2013.01); *B65B 61/08* (2013.01)

(58) Field of Classification Search
CPC ..... B65B 51/10; B65B 3/02; B65B 47/00; B65B 7/28; B65B 17/00; B31B 1/64; B65D 5/64
USPC ..... 53/487, 449, 329.3; 493/189; 229/43
See application file for complete search history.

(56) References Cited

U.S. PATENT DOCUMENTS

| | | | | |
|---|---|---|---|---|
| 7,487,625 | B2 * | 2/2009 | Natterer | B65B 9/04 53/433 |
| 2006/0123739 | A1 * | 6/2006 | Konishi | B65B 7/164 53/329.3 |
| 2010/0242411 | A1 * | 9/2010 | Boekstegers | B65B 7/165 53/449 |
| 2010/0287893 | A1 * | 11/2010 | Ehrmann | B65B 7/01 53/487 |
| 2011/0078981 | A1 | 4/2011 | Bongers-Ambrosius et al. | |
| 2012/0108408 | A1 * | 5/2012 | Schiche | B65B 61/065 493/189 |

FOREIGN PATENT DOCUMENTS

| | | | | |
|---|---|---|---|---|
| DE | 19734513 | A1 | 2/1999 | |
| DE | 102009015343 | A1 | 9/2010 | |
| DE | 102009020892 | A1 | 2/2011 | |
| DE | 102010019576 | A1 | 11/2011 | |
| EP | 0569937 | A1 * | 11/1993 | B65B 31/021 |
| EP | 2218575 | A1 | 8/2010 | |
| EP | 2305576 | A1 | 4/2011 | |

OTHER PUBLICATIONS

"Direct Drive Two-Post Car Lift Operation Explained" on http://www.bendpak.com/car-lifts/two-post-lifts/direct-drive-car-lift/, accepted on May 19, 2012.*

* cited by examiner

THERMOFORMING PACKAGING MACHINE WITH A TOP FILM FORMING STATION

CROSS-REFERENCE TO RELATED APPLICATIONS

This application claims priority to European Patent Application Number 14151966.0 filed Jan. 21, 2014, to Elmar Ehrmann, currently pending, the entire disclosure of which is incorporated herein by reference.

FIELD OF THE INVENTION

The invention relates to a thermoforming packaging machine and to a method for operating same.

BACKGROUND OF THE INVENTION

A forming station for thermoforming trays into a film web is known from DE 197 345 13 A1. The forming station comprises a lifting mechanism for raising and lowering both the forming tool lower part disposed below the film web as well as the forming tool upper part disposed above the film web. The forming tool upper part is connected via a traverse system to the lifting mechanism. The forming tool lower part is driven directly by the lifting mechanism.

DE 10 2009 020 892 A1 discloses a tray sealer with a forming station for a top film to form the latter to become a lid prior to supplying it into a sealing station. The top film forming station is disposed above a product supply which transports to the sealing station the products being located in open trays.

A thermoforming packaging machine is known from DE 10 2009 015 343 A1 which has a top film forming station for forming a slip lid into a top film. This top film forming station as well is arranged as a complete assembly above or directly above the film transport plane.

A disadvantage of prior art is that the risk of fouling or contaminating the products, the top film, and the lower film is given, for example, due to mechanical abrasion, grease, or oil on the drive unit or on other moving parts of the lifting mechanism.

SUMMARY OF THE INVENTION

The object of the present invention is to improve a thermoforming packaging machine with a top film forming station, so that the above-described disadvantages may be eliminated.

The thermoforming packaging machine according to one embodiment of the present invention with a top film forming station for forming a top film comprises a lifting mechanism, a traverse system, a forming tool upper, and a forming tool lower part, where the forming tool upper part and the forming tool lower part are arranged above a lower film transport plane. The thermoforming packaging machine according to one embodiment is characterized in that the lifting mechanism is located below the lower film transport plane, where the forming tool upper part and the forming tool lower part are connected via the traverse system to the lifting mechanism. In this embodiment, the forming tool upper part and the forming tool lower can be connected rigidly relative to the lower film transport plane, or movably relative thereto via the traverse system to the lifting mechanism. In one embodiment, both the forming tool upper part as well as the forming tool lower part are connected via the traverse system to the lifting mechanism and are thereby movable relative to the lower film transport plane. A closed force flow between the forming tool upper part, the forming tool lower part, the traverse system and the lifting mechanism may therefore be provided. All drive and guide elements, which, for example, are lubricated or which possibly experience abrasion, can be located below the film transport plane or at least not above the lower film or the products contained therein, respectively. A preferred hygienic configuration is thereby obtained. Since the forming tool upper part and the forming tool lower part are provided above the lower film transport plane, the top film can at the same time due to the low space requirement be guided at a small distance from the lower film in the direction of production and with only a slight deflection into the sealing station and towards the lower film. This may be particularly advantageous with hard films thermoformed to lids, which are not deflectable without thereby being damaged by buckling.

The lifting mechanism may be a toggle lever lifting mechanism or it may comprise a direct drive to be able to generate fast lifting motions and high closing forces for the forming process. The lifting mechanism can comprise a servo drive.

In one embodiment, the thermoforming packaging machine comprises a sealing station and a top film cutting station, where the top film cutting station is disposed along the top film between the top film forming station and the sealing station. This allows punchings and cuttings, for example, for opening aids on the package, without this having any influence on the top film forming station. With punchings into the top film already occurring upstream of the top film forming station, special seals for the openings in the top film of the forming tool would need to be considered in order to ensure the forming process.

A device for the removal of punching or cutting waste can be provided beneath the top film cutting station and above the lower film transport plane. The terms punching and cutting are to be interpreted as being alike, since in both cases slots or openings are introduced into the top film and/or parts of the top film are cut out.

The device can comprise a conveyor belt, where the conveyor belt is oriented transverse to a direction of production, for removing film waste of the top film in the fastest manner from the area above the lower film transport plane.

A top film transport device may be provided by clamp chains to securely and accurately transport the top film without creases.

The top film transport device can be provided along the top film forming station, the top film cutting station, and the sealing station or extends up to the sealing station.

The traverse system may comprise struts, for example, four struts to stably and accurately move the trays and to thereby require little space laterally beyond the films.

For example, first struts may be provided connecting the forming tool lower part to a lifting mechanism upper part of the lifting mechanism and/or second struts are provided connecting the forming tool upper part to a lever mechanism of the lifting mechanism.

The method according to the invention for operating the thermoforming packaging machine can be characterized in that a lifting mechanism is disposed below a film transport plane of the thermoforming package machine and transmits its lifting motion via a traverse system to lower and upper tools of a top film forming station which are disposed above the lower film transport plane. It is despite the slightly higher mechanical effort in this manner possible to reduce or even eliminate the risk of fouling or contaminating the products that are located on the lower film due to mechanical abrasion or oil from the lifting mechanism.

It may be advantageous if, after forming the top film in the top film forming station, cutting or punching the top film in a top film cutting station occurs prior to the top film being fed to a sealing station. The top film, still being uncut in the top film forming station, can be formed or deepdrawn in a structurally simple manner, since no previously introduced openings must be specially sealed.

A circumferential peelable seal seam and a permanent seal may be created in the sealing station, where a permanent seal forms a hinge and is created only at one side of the package. Alternatively, two consecutive sealing stations can be provided for respectively creating the circumferential peelable seal or the permanent seal.

Other and further objects of the invention, together with the features of novelty appurtenant thereto, will appear in the course of the following description.

DESCRIPTION OF THE SEVERAL VIEWS OF THE DRAWING

In the following, an advantageous embodiment of the invention is further illustrated using a drawing. Specifically.

Same components are throughout the figures designated with the same reference numerals.

DETAILED DESCRIPTION OF THE INVENTION

Figure 1:
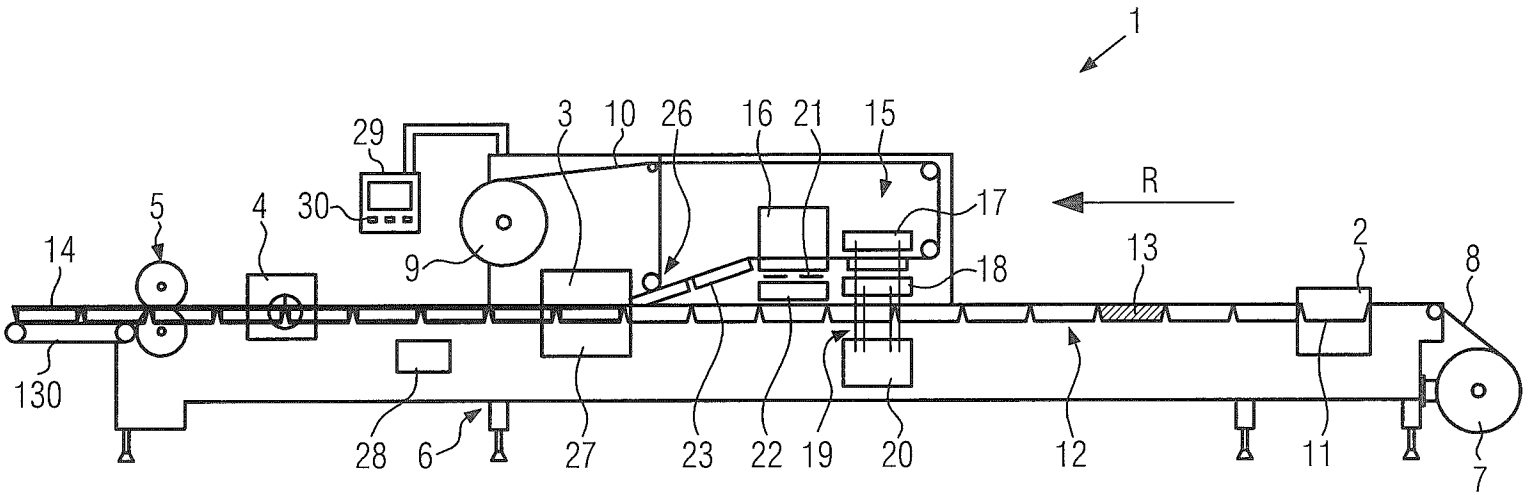
FIG. 1 is a schematic side view of a thermoforming packaging machine with a top film forming station according to one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a schematic side view of a thermoforming packaging machine 1 according to one embodiment of the present invention. This thermoforming packaging machine 1 can comprise a forming station 2, a sealing station 3, a transverse cutting device 4 and a longitudinal cutting device 5, which can be arranged in this sequence in a direction of transport R on a machine frame 6. On the inlet side, the machine frame 6 may have a supply roll 7 disposed on it from which a film 8 is drawn off. In the region of the sealing station 3, a material storage 9 can be provided from which a top film 10 is drawn off. The thermoforming packaging machine 1 may comprise a discharge device 130 on the outlet side in the form of a conveyor belt with which the fully separated packages 14 are removed. Furthermore, the thermoforming packaging machine 1 can comprise an advance device—not illustrated in more detail—which grabs the lower film 8 and transports the latter onward during a main processing cycle in the direction of transport R. The advance device can be embodied, for example, by conveyor chains or clamp chains, respectively. A lower film transport plane E (see FIGS. 2 and 3) is defined by the plane formed by the lower film 8 being held in the clamp chains.

In the embodiment illustrated, the forming station 2 is configured as a thermoforming station in which trays 11 are formed into the lower film 8 by thermoforming. The forming station 2 can thereby designed such that several trays 11 are formed adjacent to one another in the direction perpendicular to the direction of transport R. In the direction of transport R downstream of the forming station 2, a loading stretch 12 can be provided in which the trays 11 having been formed into the lower film 8 are filled with product 13.

A top film forming station 15 can be located between the loading stretch 12 and the sealing station 3 for thermoforming the top film 10 and a top film cutting station 16 downstream in the direction of transport R. A forming tool upper part 17 and a forming tool lower part 18 of the top film forming station 15 can be disposed above the lower film transport plane E and by use of a traverse system 19 (i.e., a transmission mechanism) connected to a lifting system 20 arranged below the lower film transport plane E. The lifting system 20 may be connected to the machine frame 6. The function of the traverse system 19 is to transfer the lifting motion of the lifting mechanism 20 to the forming tool upper and lower part 17 and 18. The top film forming station 15 forms cavities 23 into the top film 10, which, for example, for a re-closure function have the same orientation as the tray 11 of the lower film 8.

The top film cutting station 16 can likewise be disposed above the lower film transport plane E to cut out segments 21 from the top film 10, which then as cutting waste drop to a removal device in the form of conveyor belt 22 aligned transverse to the direction of transport R and are by the conveyor belt 22 transported away to the side into the direction of the drawing plane and thereby out of the thermoforming packaging machine 1 towards the back.

The top film 10 with the formed cavities 23 may then fed to the sealing station 3. A top film transport device 24 (see FIGS. 2 and 3) is provided at least along the top film forming station 15 and the top film cutting station 16 in the form of two clamp chains 25 disposed laterally relative to the top film 10 to laterally hold the top film 10 and transport it in the direction of transport R. Upstream of the sealing station 3, a depression device 26 can be provided in the form of one or more rollers to depress the cavities 23 in the trays 11 formed in the top film 10 when the top film 10 together with the lower film 8 simultaneously advance into the sealing station 3.

The sealing station 3 has a sealable chamber 27 in which the atmosphere in the trays 11 can prior to sealing, for example, be evacuated and/or by flushing with a gas be replaced with an exchange gas or a gas mixture.

The transverse cutting device 4 may be designed as a punch that severs the lower film 8 and the top film 10 between adjacent trays 11 in a direction transverse to the direction of transport R. The transverse cutting device 4 thereby operates in such a manner that the lower film 8 is not severed across the entire width, but is not severed at least in one edge region. This enables controlled onward transport by the advance device.

The longitudinal cutting device 5 in the illustrated embodiment is configured as a blade assembly with which the lower film 8 and the top film 10 are cut between adjacent trays 11 and at the side edge of the lower film 8, so that separated packages 14 are given downstream of the longitudinal cutting device 5.

The thermoforming packaging machine 1 can also comprise a control unit 28. It serves the purpose of controlling and monitoring the processes running in the thermoforming packaging machine 1. A display device 29 with controls elements 30 is used for visualizing or influencing the processes occurring in the package machine 1 for or by an operator, respectively.

Figure 2:
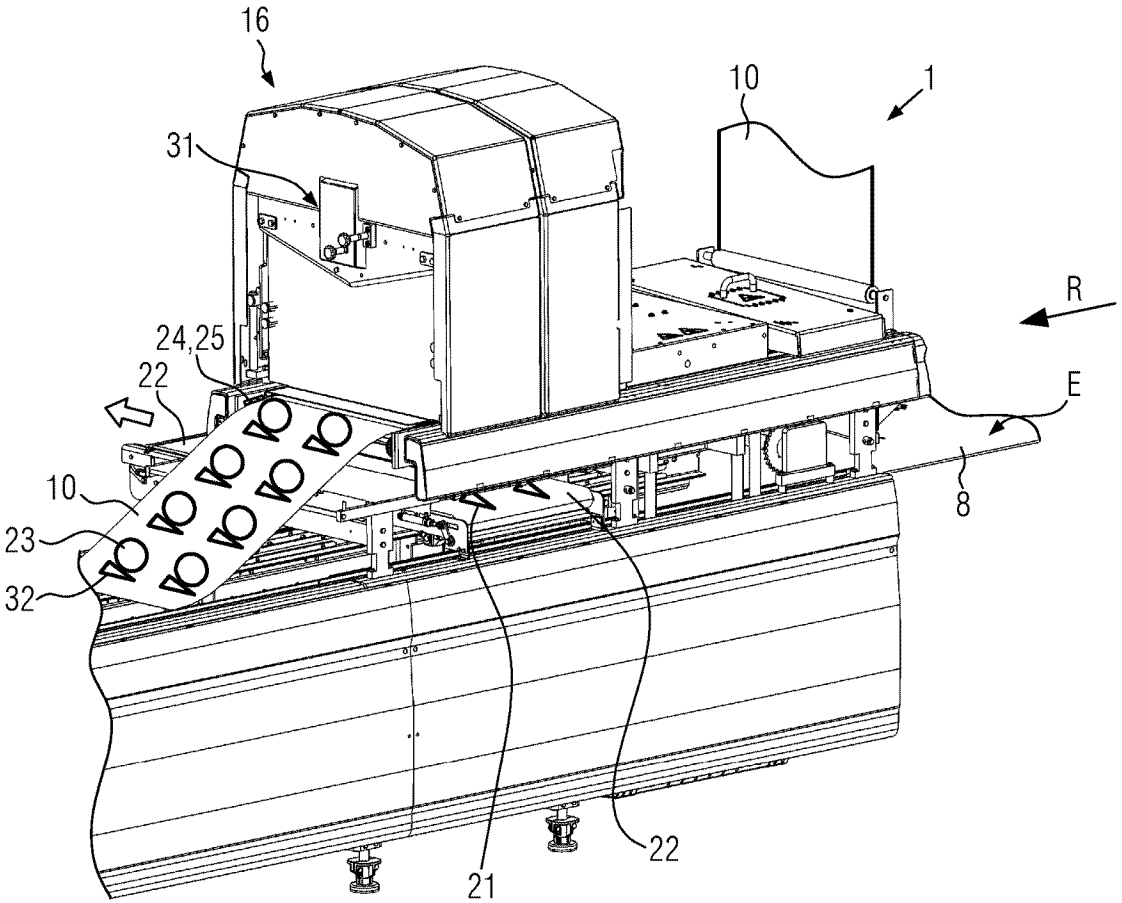
FIG. 2 is a side perspective view of a top film cutting station according to one embodiment of the present invention.

FIG. 2 shows a partial sectional view of the thermoforming packaging machine 1 with the top film cutting station 16. The top film cutting station 16 at the upper region comprises an only partially visible lifting mechanism 31 that moves a cutting blade—not shown in more detail—vertically such that segments 21 are cut out of the top film 10. Openings 32 thereby remain in the top film 10 downstream of the top film cutting station 16 which together with the openings in the lower film 8 create an improved opening aid on the finished package 14 (see FIGS. 4*a* and 4*b*). The segments 21 may drop onto the conveyor belt 22 after the cutting operation and be transported towards the back into the drawing plane to the back side of the thermoforming packaging machine 1 and received by a container, not shown in more detail.

The top film 10 may be held and guided by two clamp chains 25 disposed on both sides of the top film 10 in order to prevent wrinkling during the cutting process and the film transport motion. For changing the cutting blade or the cutting tools as an assembly, respectively, only the top film 10 must be removed from the top film cutting station 16, and the cutting tools can be slid out and removed in the direction of transport R from the top film cutting station 16.

Figure 3:
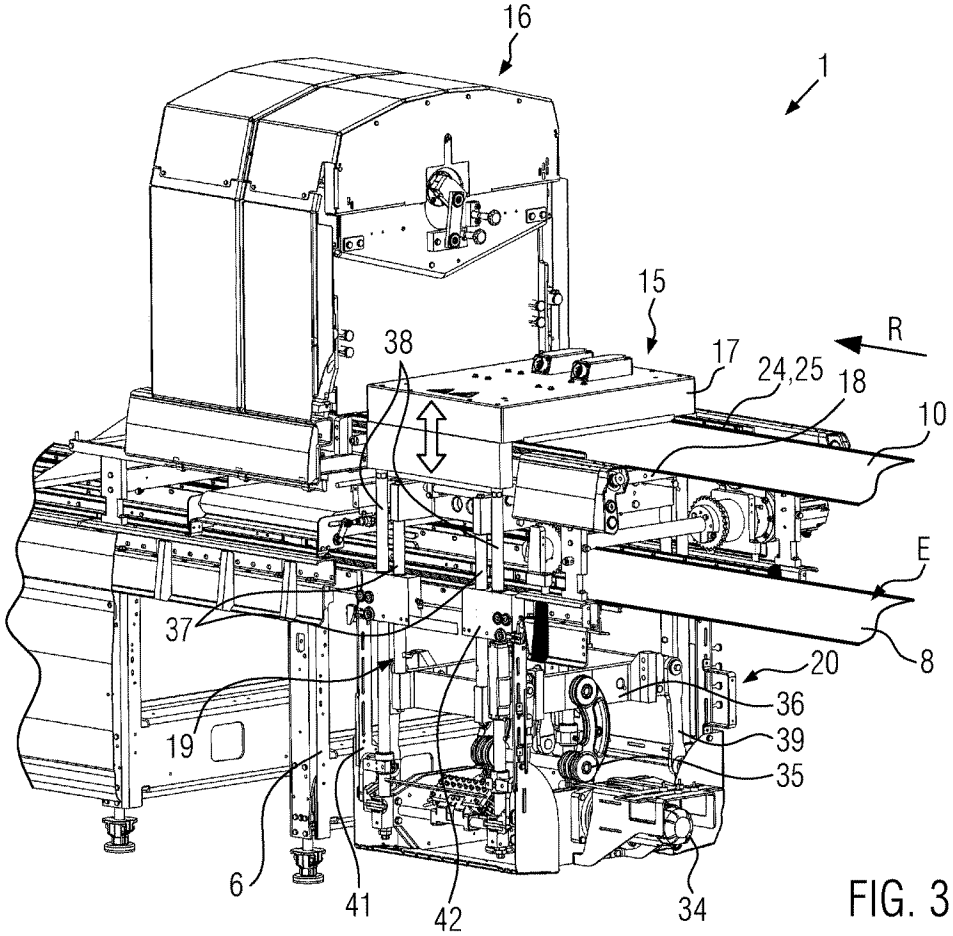
FIG. 3 is a side perspective view of a top film forming station with a lifting mechanism according to one embodiment of the present invention, illustrating the side panels and the machine frame partially cut out.

FIG. 3 shows a view of the top film forming station 15 with the lifting mechanism 20 in the direction of transport R with the side panel and the machine frame 6 partially cut out for better visibility. The lifting mechanism 20 with a servo drive 34 and a toggle lever mechanism 35 as the driving members can be mounted below the lower film transport plane E of the lower film 8 on the machine frame 6. A lifting mechanism upper part 36 can be raised and lowered via the servo motor 34 and the toggle lever mechanism 35. As illustrated, the forming tool lower part 18 is disposed above the lower film transport plane E and below the top film 10 and is connected by four first struts 37 of the traverse system 19 to the lifting mechanism upper part 36. The lifting motion of the lifting mechanism upper part 36 therefore corresponds to that of the forming tool lower part 18.

The forming tool upper part 17 is disposed above the lower film transport plane E and above the top film 10 and may be connected via four second struts 38 of the traverse system 19 to a lever mechanism 39 as a further drive member, which in turn itself exerts a vertical lifting motion which is generated by the lifting device upper part 36. The lever mechanism 39 can be configured such that the lifting motion of the forming tool upper part 17 is smaller than and opposite to the lifting motion of the forming tool lower part 18. The lifting motion of the lifting mechanism 20 thereby causes the opening and closing of the forming tools 17, 18 relative to the top film 10.

When the forming tools 17, 18 are in a closed position, namely, in the working position, the top film 10 is clamped by the forming tools 17, 18 and the top film 10 is using vacuum and/or compressed air thermoformed in one of the two forming tools 17, 18 to form cavities 23. In the embodiment presently shown, a depression or cavity 23 is created in the top film 10 downwardly into the forming tool lower part 18.

The top film 10 is upstream and inside the top film forming station 16 held and transported by the clamp chains 25. The clamp chains 25 can be provided until downstream of the top film cutting station 16 and are moved synchronously with the advance of the lower film 8. The lifting mechanism 20 and therefore also the entire top film forming station 15 is connected to four supports 41 having four guides 42 as guide elements in which the first struts 37 and the second struts 38 of the traverse system 19 are mounted and guided vertically movable, where the guides 42 are connected to the machine frame 6 in order to enable a force flow within the top film forming station 15. The respective four first struts 37 and second struts 38 of the traverse system 19 may be arranged in the direction of transport R to the right and to the left beyond the lower film 8 and the top film 10 and are therefore not in conflict with the films 8, 10.

Figure 4B:
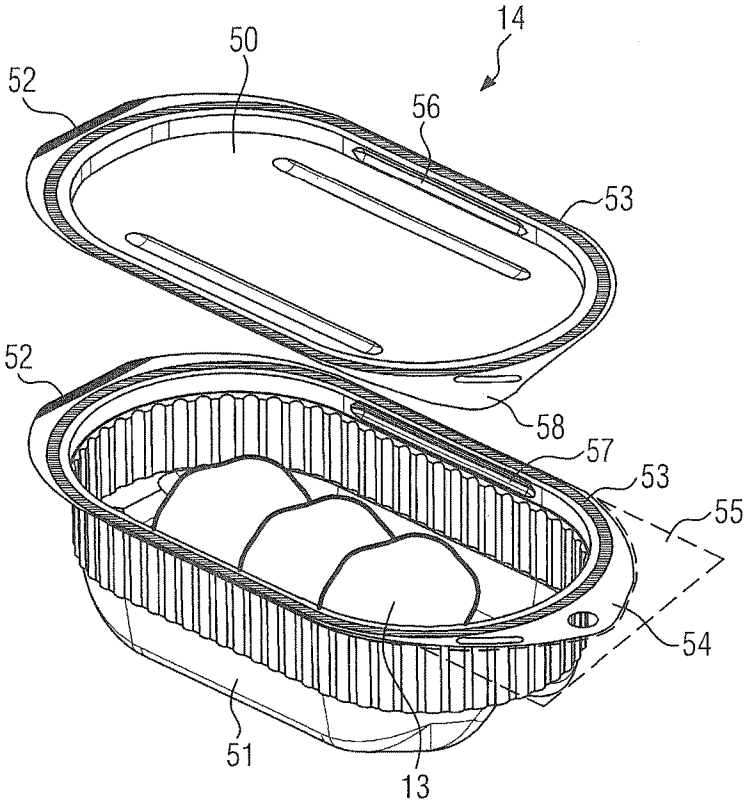
FIG. 4*b* is a top perspective view of the package according to one embodiment of the present invention.
Figure 4A:
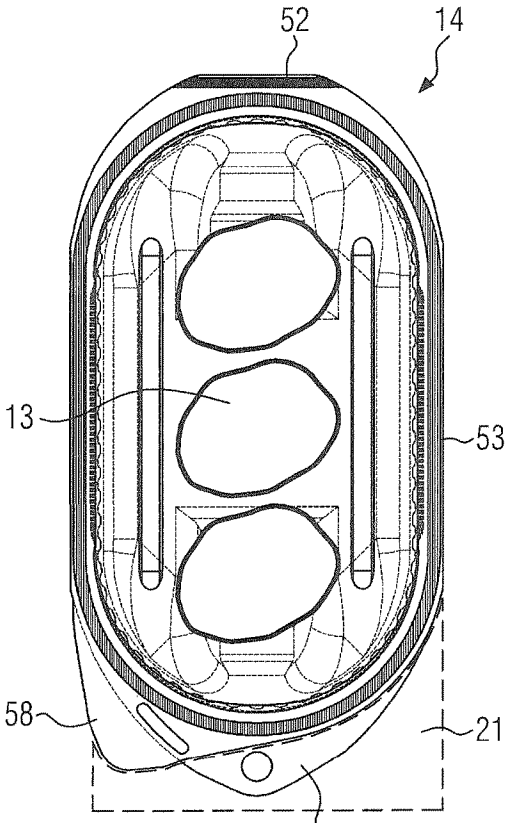
FIG. 4*a* is a plan view of a package according to one embodiment of the present invention.

FIG. 4*a* shows a package 14 that can be produced with such a thermoforming packaging machine 1 according to the invention. FIG. 4*b* shows the package 14 with a lid 50 that is separated for the graphic representation 50 and which was created in the top film 10 by the top film forming station 15 and the top film cutting station 16. A package base part 51 has been created in the lower film 8. A seal 52 provided only at an edge portion and created in the sealing station 3 creates a hinge function, because this seal 52 can be stronger than a circumferential peelable sealing seam 53 sealing the top film 10 at a tray edge 54 of the lower film 8 to the lower film 8 in an air-tight manner in order to pack the product 13 into the tray so as to have a longer life. In FIG. 4*a*, a dashed line is provided representing a segment which was cut out in the top film cutting station 16, where a tab 58 remains as an opening aid. The tab 58 can be easily grasped with two fingers of one hand since the package base 51 in this region has no film material because it has already been cut out from the lower film 8 in a lower film cutting station, not shown in more detail in FIG. 1. The cut-out piece of film 55 is in FIG. 4*b* indicated by a dashed line. Furthermore, package 14 can comprise re-closure studs 56 on two oppositely disposed sides of the lateral inner wall of the lid 50 which engage accordingly with the depressions 57 in the side walls of the package base 51 in order to be able to re-close the package 14, albeit not in an airtight manner, following the initial opening of the package 14 and the resulting destruction or detachment of the seal 53. The hinge 52 provides for the lid 50 to remain firmly attached to the package base 51.

From the foregoing, it will be, seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A thermoforming packaging machine comprising:

a lower film forming station for forming a tray in a lower film;

a top film forming station for forming cavities in a top film, wherein said top film and said top film forming station are disposed above said lower film and a lower film transport plane of said lower film, and said top film is conveyed through said top film forming station in a top film transport plane that is substantially parallel to the lower film transport plane; and said top film forming station comprises:

a lifting mechanism disposed below said lower film transport plane of said lower film;

a traverse system;

a forming tool upper part disposed above said lower film transport plane and above the top film transport plane; and a forming tool lower part disposed above said lower film transport plane and below the top film transport plane;

wherein at least one of said forming tool upper part and said forming tool lower part are disposed for movement in a direction transverse to said lower film transport plane, and operably connected to said lifting mechanism by said traverse system, wherein said traverse system comprises one or more struts, each of said one or more struts operably connecting and spanning between said at least one of said forming tool upper part and said forming tool lower part and said lifting mechanism, wherein each of said one or more struts passes through said lower film transport plane, and each of said one or more struts transfer a lifting force from the lifting mechanism to said at least one of said forming tool upper part and said forming tool lower part through the lower film transport plane, wherein said lifting force is in a direction substantially transverse to said lower film transport plane.

2. The thermoforming packaging machine according to claim 1, wherein said lifting mechanism is a toggle lever lifting mechanism or a direct drive.

3. The thermoforming packaging machine according to claim 1, wherein said lifting mechanism comprises a servo drive.

4. The thermoforming packaging machine according to claim 1 further comprising a sealing station and a top film cutting station, wherein said top film cutting station is disposed between said top film forming station and said sealing station.

5. The thermoforming packaging machine according to claim 4, wherein a removal device is provided below said top film cutting station and above said lower film transport plane for removing cutting waste.

6. The thermoforming packaging machine according to claim 5, wherein said removal device comprises a conveyor belt aligned generally transversely to a direction of transport of said lower film.

7. The thermoforming packaging machine according to claim 1 further comprising a top film transport device including clamp chains.

8. The thermoforming packaging machine according to claim 7, wherein said top film transport device is provided along said top film forming station and a top film cutting station.

9. The thermoforming packaging machine according to claim 1, wherein one or more first struts connect said forming tool lower part to a lifting mechanism upper part of said lifting mechanism.

10. The thermoforming packaging machine according to claim 9, wherein one or more second struts connect said forming tool upper part to a lever mechanism of said lifting mechanism.

11. The thermoforming packaging machine according to claim 1, wherein said lower film transport plane is horizontal and said at least one of said forming tool upper part and said forming tool lower part operably connected to said lifting mechanism is disposed for a vertical lifting motion.

12. The thermoforming packaging machine according to claim 1, further comprising a sealing station, wherein the said top film forming station is upstream of said sealing station in a direction of production.

13. The thermoforming packaging machine according to claim 1, wherein one or more first struts are provided that connect said forming tool upper part to a lever mechanism of said lifting mechanism.

14. A method for operating a thermoforming packaging machine, said method comprising the steps of:

disposing a lifting mechanism for a top film forming station below a lower film transport plane of a lower film of the thermoforming packaging machine;

disposing a forming tool upper part of the top film forming station above said lower film transport plane;

disposing a forming tool lower part of the top film forming station above said lower film transport plane;

transmitting a lifting motion of said lifting mechanism in a direction perpendicular to the lower film transport plane to at least one of said forming tool upper part and said forming tool lower part using a traverse system extending through said lower film transport plane, wherein said traverse system comprises one or more struts disposed between and operably connecting said lifting mechanism and said at least one of said forming tool upper part and said forming tool lower part, wherein said one or more struts pass through the lower film transport plane; and sealing a container formed from said top film and said lower film in a sealing station; and forming cavities in a top film in said top film forming station prior to said top film reaching said sealing station, wherein the top film forming station is upstream said sealing station in a direction of production.

15. Method according to claim 14 further comprising the step of cutting or punching said top film in a top film cutting station after said top film has been formed in said top film forming station but before said top film has been fed to said sealing station.

16. Method according to claim 14, wherein a circumferential peelable seal seam and a permanent seal are created in said sealing station, where said permanent seal forms a hinge and is created only at one side of a package.

17. A thermoforming packaging machine comprising:

a lower film conveyed through said thermoforming packaging machine in a lower film transport plane;

a top film forming station for forming cavities in a top film, said top film conveyed through said top film forming station in a top film transport plane, where said top film transport plane is parallel to said lower film transport plane at said top film forming station, and wherein said top film and said top film forming station are disposed above said lower film and said lower film transport plane of said lower film;

and said top film forming station comprises:

a lifting mechanism disposed below said lower film transport plane of said lower film, the lifting mechanism comprising a lifting mechanism upper part;

a traverse system comprising a first set of four struts;

a forming tool upper part disposed above said lower film transport plane and above said top film transport plane; and a forming tool lower part disposed above said lower film transport plane and below said top film transport plane, said first set of four struts disposed between and operably connected to said forming tool lower part and said lifting mechanism upper part;

wherein said first set of four struts passes through the lower film transport plane to transfer a first lifting force from the lifting mechanism upper part to said forming tool lower part to move said forming tool lower part in a direction substantially perpendicular to said lower film transport plane.

18. The thermoforming packaging machine according to claim 17, wherein said traverse system further comprises a second set of four struts, and a lever mechanism, and wherein a first end of each of said second set of four struts is operably connected to said forming tool upper part and a second end of each of said second set of four is operably connected to said lever mechanism such that each of said second set of struts passes through said lower film transport plane, and wherein said lever mechanism is operably connected to said lifting mechanism upper part, wherein said second set of four struts and said lever mechanism transfer a second lifting force from said lifting mechanism upper part to said forming tool upper part through said lower film transport plane to move said forming tool upper part in a direction substantially perpendicular to said lower film transport plane at said top film forming station.

19. The thermoforming packaging machine according to claim 18, wherein upon a movement of said lifting mechanism upper part, the first lifting force causes said forming tool lower part to displace a first distance and said second lifting force causes said forming tool upper part to displace a second distance, wherein said second distance is less than and in an opposing direction of said first distance.

20. The thermoforming packaging machine according to claim 17, further comprising a sealing station, wherein the said top film forming station is upstream of said sealing station in a direction of production.

* * * * *